United States Patent [19]

Fuller

[11] 4,149,644

[45] Apr. 17, 1979

[54] FORK LIFT TRUCK ATTACHMENT

[75] Inventor: Richard C. Fuller, Lockport, N.Y.

[73] Assignee: General Motors Corporation, Detroit, Mich.

[21] Appl. No.: 888,173

[22] Filed: Mar. 20, 1978

[51] Int. Cl.[2] ..... E05F 13/02; B66F 9/12

[52] U.S. Cl. ..... 414/607; 105/378; 105/462; 414/373

[58] Field of Search ..... 214/44 R, 620; 105/378, 105/462; 254/133; 49/276

[56] References Cited

U.S. PATENT DOCUMENTS

| | | | |
|---|---|---|---|
| 1,119,568 | 12/1914 | Blood | 105/462 |
| 1,496,401 | 6/1924 | Alfrey | 214/44 R X |
| 1,593,840 | 7/1926 | Money | 214/44 R X |
| 3,101,128 | 8/1963 | Dane | 214/620 X |
| 3,595,414 | 7/1971 | Brown et al. | 214/620 X |
| 3,965,760 | 6/1976 | Etheredge | 214/44 R X |

*Primary Examiner*—L. J. Paperner

*Attorney, Agent, or Firm*—Edward J. Biskup

[57] ABSTRACT

An attachment for a fork lift truck that facilitates opening and closing of railway freight car doors. The attachment includes a base plate which pivotally supports a push arm at each side thereof that is connected to means for providing a controlled shock absorbing pushing force to the door so as to prevent damage thereto.

3 Claims, 4 Drawing Figures

FORK LIFT TRUCK ATTACHMENT

The invention concerns a railway car door opener-closer device designed to be mounted on the two forks of a fork lift truck and incorporating shock absorbing means so as to reduce damage to the door during a closing or opening operation.

More specifically, the car door opener-closer device according to the invention includes a base plate provided with a pair of parallel pockets which receive the forks of a fork lift truck. Once the base plate is mounted on the forks, it is located in a substantially horizontal plane ahead of the fork lift truck and is in a position to facilitate the opening and closing of the railway freight car door. The base plate is defined by a transverse front wall and a pair of side walls with the side walls having a portion thereof located outboard of the wheels of a fork lift truck and cooperating with the front wall to define a pair of laterally spaced outer corners. A pair of push arms are pivotally mounted on the base plate with one push arm being located adjacent one of the outer corners and the other push arm being located at the other outer corner. Spring means are connected to each of the push arms for absorbing the pushing force on the door during the opening and closing operation thereof.

The object of the present invention are to provide a new and improved attachment for a fork lift truck that facilitates the opening and closing of railway freight car doors; to provide a new and improved fork lift attachment for opening and closing freight car doors that incorporates shock absorbing means which protect the fork lift mast and carriage assembly from impact damage; to provide a new and improved freight car door opener-closer that is adapted to be mounted on the forks of a fork lift truck and permits the truck to travel along side the freight car with the force applied in a direction parallel to the door travel; to provide a new and improved freight car door opener-closer that is supported by a fork lift truck and allows the entire door opening and closing operation to be in full view of the operator and employs shock absorbing means for preventing any damage to the door during the opening and closing operations; and to provide a new and improved freight car door opener-closer that includes a pivoted push arm at one side edge of a flat horizontally oriented plate-like member with the push arm being connected to an accumulator for providing a controlled shock absorbing pushing force to the car door during an opening and closing operation.

Other objects and advantages of the invention will be more apparent from the following detailed description when taken with the drawings in which.

Figure 1:
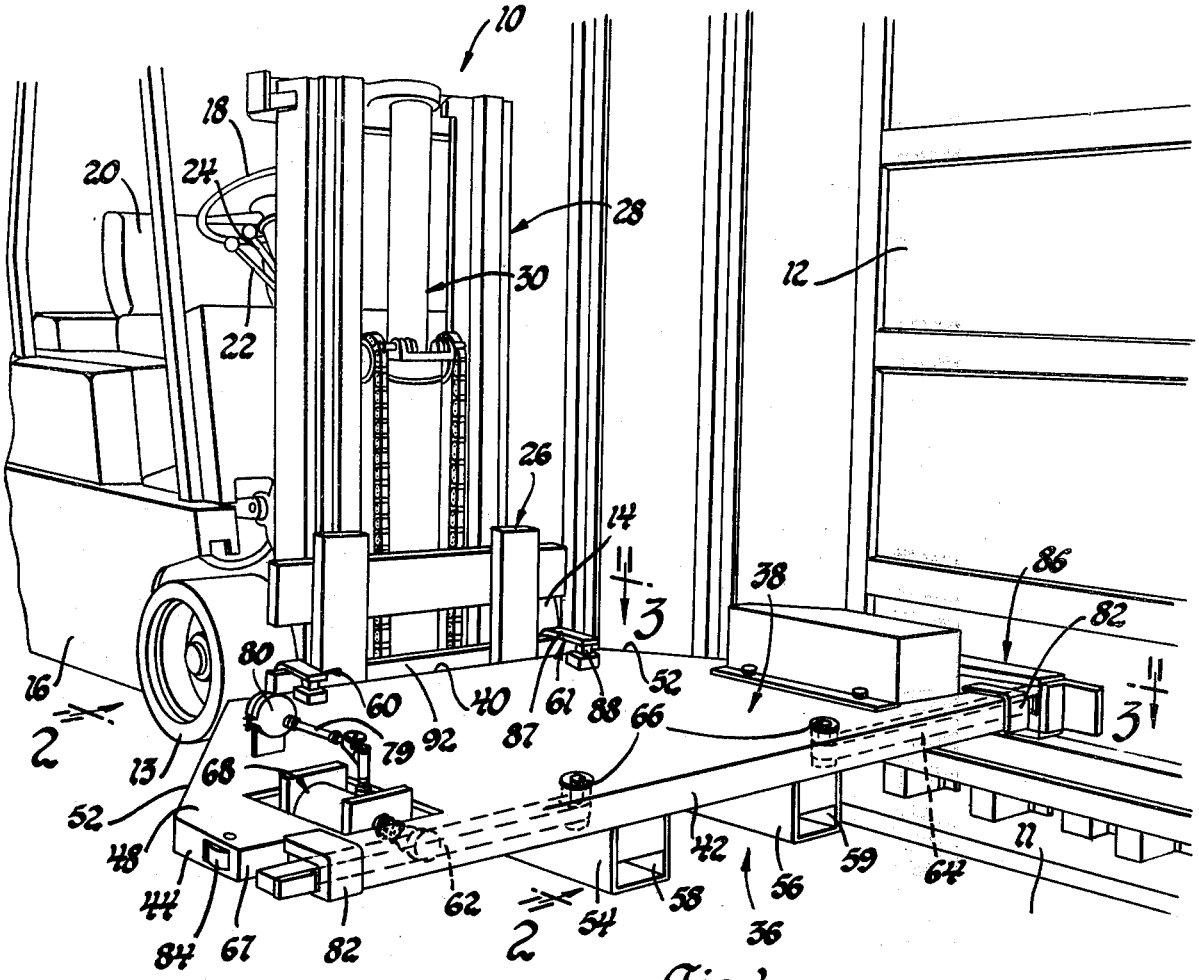
FIG. 1 is a perspective view showing a fork lift truck provided with a freight car door opener-closer device made according to the invention.

Referring to the drawings and more particularly to FIG. 1 thereof, a fork lift truck 10 is shown located on the floor portion 11 of a loading dock adjacent to a railway freight car provided with the usual side door 12. As is conventional, the fork lift truck 10 has the front wheels 13 and 14 thereof rotatably mounted to the front end of a body 16 which includes an operator's station provided with a steering wheel 18 and a seat 20 for the driver. Adjacent the steering wheel 18, a pair of control levers 22 and 24 are provided for controlling the raising and lowering of a carriage 26 along a mast 28 mounted to the front end of the vehicle body 16. A hydraulic cylinder and chain drive arrangement 30 is supported by the mast 28 and operated by the control levers 22 and 24 for vertically positioning the carriage 26 along the mast 28. The lower portion of the carriage 26 is provided with the usual pair of forwardly extending parallel forks 32 and 34 which in this case support a freight car door opener-closer device 36 made according to the invention.

More specifically, the freight car door opener-closer device 36 comprises a base plate member 38 defined by a rear wall 40, a front wall 42, a pair of laterally spaced side walls 44 and 46, a top wall 48 and a bottom wall 50. Each of the side walls 44 and 46 is connected to the rear wall 40 by an angularly related wall 52. In the preferred form, the top and bottom walls 48 and 50 are located in spaced horizontal planes while the front and rear walls 42 and 40 are vertically oriented and parallel to each other. Similarly, the side walls 44 and 46 are vertically oriented and parallel to each other.

Figure 3:
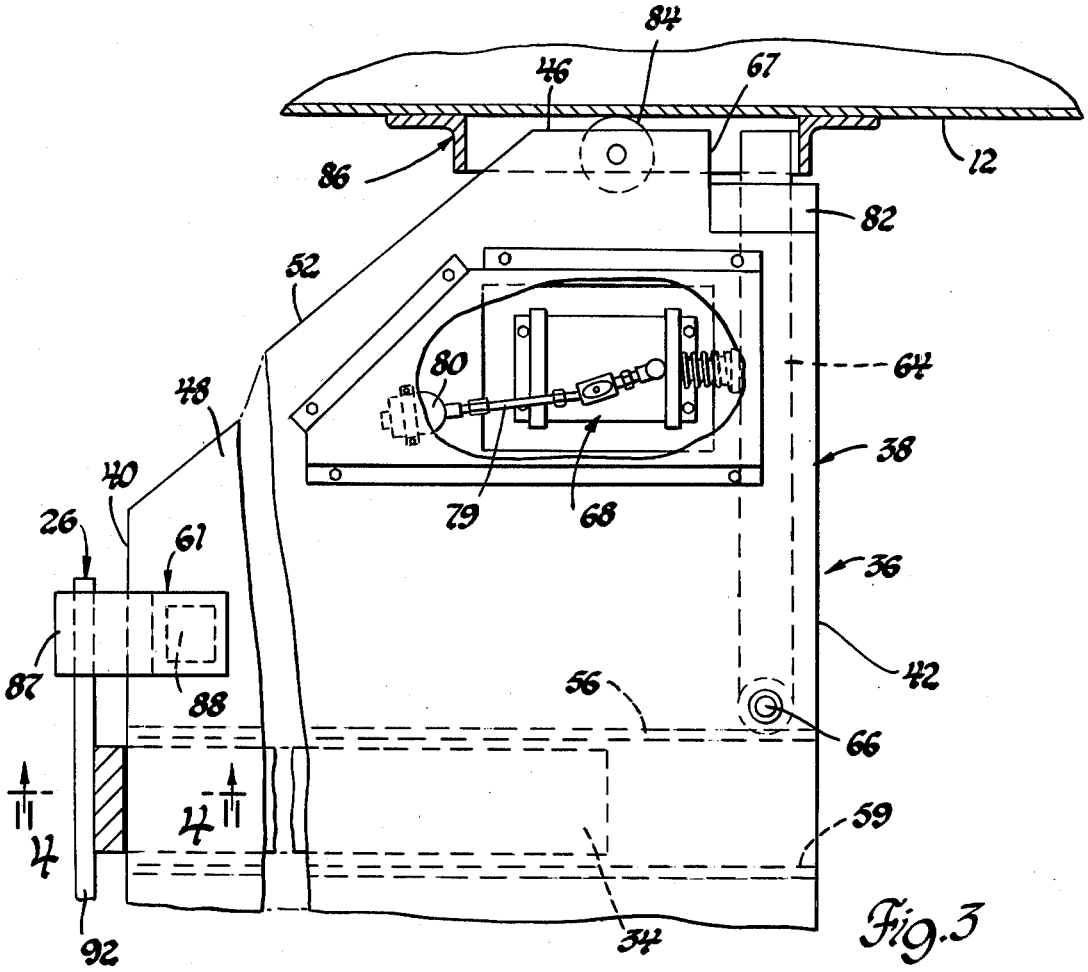
FIG. 3 is an enlarged plan view of one side edge of the car door opener-closer device taken on lines 3—3 of FIG. 1.

The bottom wall 50 rigidly supports a pair of parallel U-shaped channel members 54 and 56 each of which is arranged with its longitudinal center axis extending perpendicular to the front and rear walls of the base plate 38. The channel members 54 and 56 are laterally spaced from each other a distance equal to the spacing of the forks 32 and 34 of the fork lift truck so as to allow the latter mentioned forks to enter pockets 58 and 59 which are rectangular in cross section and are defined in part by the channel members. In this manner, the forks 32 and 34 of the fork lift truck 10 respectively enter the pockets 58 and 59 and serve to support the car door opener-closer device 36 with the rear wall 40 of the base plate 38 being in contact with the carriage 26 as seen in FIG. 3. Moreover, once the carriage 26 is raised so as to have the lower portion of the device 36 out of contact with the floor portion 11, a pair of lock members 60 and 61 mounted in the rear portion of the base plate 38 adjacent the rear wall 40 automatically engage the lower cross bar of the carriage 26 and lock the door opener-closer device 36 thereto as will be more fully explained hereinafter.

Figure 2:
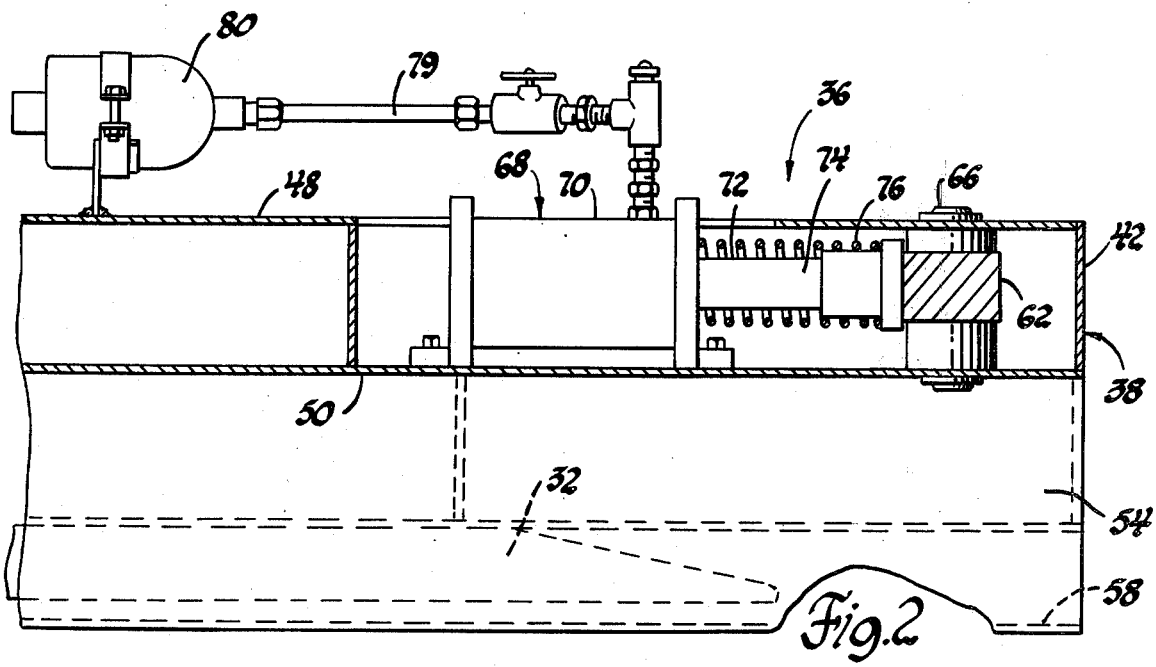
FIG. 2 is an enlarged sectional view of the car door opener-closer device taken on lines 2—2 of FIG. 1.

The front portion of the base plate 38 is provided with a pair of identical push arms 62 and 64 located adjacent the front wall 42. Each push arm 62 and 64 has the inner end thereof supported by a pin 66 for pivotal movement about a vertical axis while the outer end extends out of a notch portion 67 formed in each corner of the base plate at the intersection of the front wall 42 and the adjacent side wall. As seen in FIGS. 2 and 3, a shock absorber 68 is provided adjacent each push arm 62 and 64 and contacts an intermediate portion of the associated push arm. The shock absorber 68 includes a cylinder member 70 fixed with the base plate 38 and a relatively reciprocable piston member 72 having a rod portion 74 that abuts the rear face of the associated push arm. In each case, a coil spring 76 is located between the cylinder member 70 and an enlarged head fixed to the outer end of the rod portion 74. In addition, each shock absorber 68 is connected by a conduit arrangement 79 to an accumulator 80 mounted on the top wall 48 of the base plate 38 to the rear of the cylinder member 70. The accumulator 80 is charged with pressurized nitrogen which through hydraulic fluid acts against the piston member 72 to augment the force applied by the spring 76 to the associated push arm. In this manner, the accumulator pressure and the spring 76 normally maintain the outer end of the push arm in contact with the inner surface of a U-shaped stop member 82 secured to the base plate 38 adjacent each notch portion. In addition, it will be noted that a roller 84 is rotatably mounted adjacent each slide wall 44 and 46 and cooperates with the outer end of the associated push arm for facilitating opening and closing of the freight car doors as will now be explained.

In this connection and as seen in FIGS. 1 and 3, during a door closing operation, the fork lift truck 10 is driven substantially parallel to the longitudinal axis of the freight car along the floor portion 11 of the dock with the side wall 46 of the base plate 38 positioned within the "push here" bracket 86 attached to the freight car door 12. As the fork lift truck 10 moves forwardly, the outer end of the push arm 64 engages the bracket 86 as seen in FIG. 3, and the truck is then driven slowly in the closing direction of the door 12. As the door 12 moves in the closing direction, the resistance of the door 12 acts against the accumulator pressure causing the outer end of the push arm 64 to move in a counterclockwise direction out of contact with the stop member 82. During this time, the roller 84 serves as a spacer for maintaining the outer edge of the push arm out of engagement with the outer face of the door 12. When the resisting force of the door 12 is balanced by the accumulator pressure and the spring force, the door 12 begins to close with the truck being driven in the closing direction until the door is fully closed. As should be apparent, opening of the door 12 can be realized by having the fork lift truck positioned for movement in an opposite direction with the side wall 44 and the push arm 62 located within the bracket 86.

Moreover, it should be noted that by raising the carriage 26, the push arms 62 and 64 can be positioned at various heights for engaging either side edge of the door 12 for applying an opening or closing force thereto. In such case, the rooller 84 again serves as a spacer for preventing the outer end of the push arm from contacting any obstructions along the vertical side wall of the freight car.

The push arms 62 and 64 can be designed to oscillate a few inches at their outer ends with the shock absorber providing continuous protection at each point of door resistance during the seven to eight foot travel distance during the closing or opening of the freight car door. In this regard, in one form of a car door opener-closer made according to the invention, the outer end of each push arm was capable of oscillating three inches. Each push arm 62 and 64 measured 30 inches from the pin 66 to the outer end of the arm. The longitudinal center axis of the pistpon rod 74 was located 17.5 inches from the pin 66 of the associated push arm and the latter was rectangular in cross section measuring 1.5 × 2.5 inches. The spring 76 provided a preload of approximately 20 lbs. while the shock absorber combined with each push arm was made by Enidine Inc., Buffalo, N.Y., and identified as Enidene HU-RLH 2X2FM-02. The accumulator was made by Hydrodyne Inc. of Long Island, New York and identified as Model AU .12520 (one pint capacity). The accumulator had a piston area equal to 2.08 sq. inch and served to prevent any premature bottoming of the push arm when it was preset to provide an initial resistance force of 685 lbs. This static force was found to overcome an extremely slow movement of the fork lift truck which could cause premature full retraction of the piston member of the shock absorber.

Figure 4:
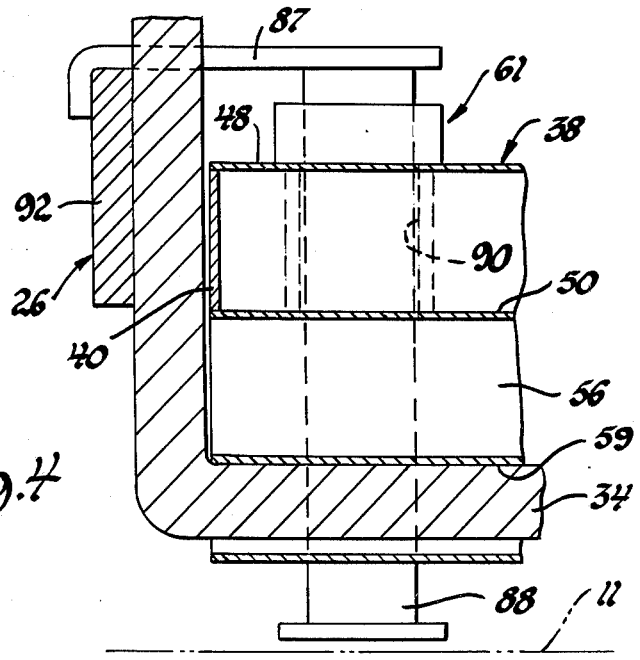
FIG. 4 is an enlarged sectional view of one of the lock members incorporated with the car door opener-closer and taken on lines 4—4 of FIG. 3.

As alluded to hereinbefore, the lock members 60 and 61 serve to lock the door opener-closer device 36 to the carriage 26. The lock members 60 and 61 also serve to decrease the side forces which would normally be imposed upon the forks 32 and 34 during a pushing operation by having a major part of the forces taken by the carriage 26. In this connection, it will be noted that the lock members 60 and 61 are identical in construction and as seen in FIG. 4, each includes an L-shaped hook portion 87 which is secured to the upper end of a support member 88. The support member 88 is mounted for vertical movement within an aperture 90 which allows the support member 88 to move freely along its longitudinal axis.

When the door opener-closer device 36 is to be removed from the carriage 26, the latter is lowered so as to cause the lower surface of the channel members 54 and 56 to rest on the floor portion 11. During the lowering movement, the lower end of each support member 88 will first contact the floor portion 11 and cause the hook portion 87 of each lock member 60 and 61 to be raised relative to the cross bar 92 of the carrige 26. As a result, the car door opener-closer device 36 is placed in an unlocked condition relative to the carriage permitting the fork lift truck 10 to more rearwardly and remove the forks 32 and 34 from the accommodating pockets 58 and 59. When the car door opener-closer device 36 is to be mounted on the forks 32 and 34, the truck 10 approaches the base plate 38, inserts the forks into the pockets 58 and 59, and moves forwardly until the back wall 40 engages the uprights of the carriage 26. The carriage 26 is then raised during which movement the lock members 60 and 61 move by gravity downwardly relative to the cross bar 92 and automatically cause the hook portion 87 to be locked to the cross bar 92 as seen in FIG. 4. Various changes and modifications can be made in this construction without departing from the spirit of the invention. Such changes and modifications are contemplated by the inventor and he does not wish to be limited except by the scope of the appended claims.

The embodiments of the invention in which an exclusive property or privilege is claimed are defined as follows:

1. An attachment for the forks of a fork lift truck that serves to facilitate opening and closing the door of a railway box car, said attachment comprising a base plate provided with a pair of parallel pockets for received said forks so as to locate the base plate in a substantially horizontal plane ahead of the fork lift truck, said base plate including a transverse front wall and a pair of side walls, the side walls having a portion thereof located outboard of the wheels of the fork lift truck and cooperating with said front wall to define a pair of laterally spaced outer corners, a pair of pusher arms adapted to selectively engage said door, means pivotally mounting one pusher arm on said base plate adjacent one of said outer corners, means pivotally mounting the other of said pusher arms on said base plate adjacent the other of said outer corners, and spring means connected to each of said pusher arms for providing a controlled shock absorbing pushing force to the door by each of the pusher arms so as to prevent damage to said door.

2. An attachment for the forks of a fork lift truck that serves to facilitate opening and closing the door of a railway box car, said attachment comprising a base plate provided with a pair of parallel pockets for receiving said forks so as to locate the base plate in a substantially horizontal plane ahead of the fork lift truck, said base plate including a transverse front wall and a pair of side walls, the side walls having a portion thereof located outboard of the wheels of the fork lift truck and cooperating with said front wall to define a pair of laterally spaced outer corners, a pair of elongated pusher arms adapted to selectively engage said door, each of said pair of pusher arms having its longitudinal center axis located substantially parallel to said front wall, means pivotally mounting one pusher arm on said base plate adjacent one of said outer corners, means pivotally mounting the other of said pusher arms on said base plate adjacent the other of said outer corners, and shock absorber means including an accumulator connected to each of said pusher arms intermediate the ends thereof for providing a controlled pushing force to the door by each of the pusher arms so as to prevent damage to said door.

3. An attachment for a fork lift truck provided with a carriage having a pair of forks and serving to facilitate opening and closing the door of a railway box car, said attachment comprising a base plate provided with a pair of parallel pockets for receiving said forks so as to locate the base plate in a substantially horizontal plane ahead of the fork lift truck, said base plate including a transverse front wall and a pair of side walls, the side walls having a portion thereof located outboard of the wheels of the fork lift truck and cooperating with said front wall to define a pair of laterally spaced outer corners, a pair of pusher arms adapted to selectively engage said door, means mounting one pusher arm on said base plate adjacent one of said outer corners for pivotal movement about a first vertical axis, means mounting the other of said pusher arms on said base plate adjacent the other of said outer corners for pivotal movement about a second vertical axis, a shock absorber connected to each of said pusher arms for providing a controlled pushing force to the door by each of the pusher arms so as to prevent dammage to said door, and a pair of vertically slidable lock members mounted on said base plate for automatic locking engagement with said carriage when said base plate is raised upwardly from a floor supporting position, said lock members adapted to be automatically released from locking engagement with the carriage when the base plate is lowered to the floor supporting position.

* * * * *